US007229399B2

(12) United States Patent
Stroucken et al.

(10) Patent No.: US 7,229,399 B2
(45) Date of Patent: Jun. 12, 2007

(54) SCREW CONVEYOR FOR A DECANTER CENTRIFUGE

(75) Inventors: Klaus Hans Dieter Stroucken, Ronninge (SE); Rolf Ridderstrale, Stockholm (SE); Robert Geiding, Tullinge (SE); Kasper Höglund, Rönninge (SE)

(73) Assignee: Alfa Laval Corporate AB, Lund (SE)

( * ) Notice: Subject to any disclaimer, the term of this patent is extended or adjusted under 35 U.S.C. 154(b) by 0 days.

(21) Appl. No.: 10/556,223

(22) PCT Filed: May 27, 2004

(86) PCT No.: PCT/SE2004/000814

§ 371 (c)(1),
(2), (4) Date: Sep. 26, 2006

(87) PCT Pub. No.: WO2004/110637

PCT Pub. Date: Dec. 23, 2004

(65) Prior Publication Data

US 2007/0049480 A1 Mar. 1, 2007

(30) Foreign Application Priority Data

Jun. 18, 2003 (SE) ..... 0301779

(51) Int. Cl.
*B04B 1/20* (2006.01)

(52) U.S. Cl. ..... 494/53

(58) Field of Classification Search ..... 494/50–56, 494/67; 210/380.1, 380.3
See application file for complete search history.

(56) References Cited

U.S. PATENT DOCUMENTS

| | | | | | |
|---|---|---|---|---|---|
| 3,447,742 | A | * | 6/1969 | Eriksson et al. | 494/53 |
| 3,885,734 | A | * | 5/1975 | Lee | 494/25 |
| 4,037,781 | A | * | 7/1977 | High | 494/51 |
| 4,245,777 | A | * | 1/1981 | Lavanchy | 494/53 |
| 4,378,906 | A | * | 4/1983 | Epper et al. | 494/54 |
| 5,156,751 | A | * | 10/1992 | Miller | 210/787 |
| 5,306,225 | A | * | 4/1994 | Miyano et al. | 494/53 |
| 5,342,281 | A | * | 8/1994 | Unkelbach et al. | 494/53 |
| 5,354,255 | A | * | 10/1994 | Shapiro | 494/53 |
| 5,800,332 | A | | 9/1998 | Hensley | |
| 6,024,686 | A | * | 2/2000 | Madsen | 494/54 |
| 6,572,524 | B1 | * | 6/2003 | Caldwell | 494/53 |
| 6,749,552 | B1 | * | 6/2004 | Figgener et al. | 494/53 |
| 7,156,801 | B2 | * | 1/2007 | Dircks et al. | 494/54 |

FOREIGN PATENT DOCUMENTS

| | | | |
|---|---|---|---|
| DE | 1532678 | * | 3/1970 |
| DE | 2131427 | * | 12/1971 |
| EP | 0 602 766 | A2 | 6/1994 |
| EP | 520 010 | B1 | 10/1994 |
| EP | 785029 | A1 * | 7/1997 |
| EP | 1260273 | A1 * | 11/2002 |
| JP | 10-151369 | * | 6/1998 |
| JP | 2005074374 | A * | 3/2005 |

* cited by examiner

*Primary Examiner*—Charles E. Cooley
(74) *Attorney, Agent, or Firm*—Michaud-Duffy Group LLP

(57) ABSTRACT

A screw conveyor intended and formed for use in a decanter centrifuge for separation of solid particles from a fluid compound, comprising a central body, at least one conveyor thread and at least one baffle bridging a flow path formed between different parts of the conveyor thread. The screw conveyor has at least two originally separate parts, each of which comprises a portion of said conveyor thread and which are kept together axially. The baffle constitutes a separate member arranged to be kept in place between said parts of the screw conveyor, when these parts are kept together axially, and has a portion which forms a part of the conveyor thread in an area where the conveyor thread intersects with and extends past the baffle.

12 Claims, 2 Drawing Sheets

SCREW CONVEYOR FOR A DECANTER CENTRIFUGE

FIELD OF THE INVENTION

The present invention relates to a screw conveyor intended and formed for use in a decanter centrifuge for separation of solid particles from a fluid compound, in which such particles are suspended in a liquid having a smaller density than the particles, the decanter centrifuge comprising a rotor, which has an inlet for said compound, an outlet for separated solid particles and an outlet for liquid having been freed from solid particles, and which rotor is rotatable about a rotational axis at a first velocity, and a screw conveyor, which is arranged in the rotor and is rotatable about the rotational axis at a second velocity different from the first velocity, the screw conveyor comprising a central body, which extends along the rotational axis, at least one conveyor thread, which extends like a screw thread along and about the central body and is supported by the same such that a screw shaped flow path is formed around the body, and at least one baffle, which bridges said flow path between different parts of the conveyor thread to prevent free movement of liquid and solid particles along the flow path towards said outlet for solid particles.

BACKGROUND OF THE INVENTION

A screw conveyor of this kind is described in U.S. Pat. No. 3,885,734 and in U.S. Pat. No. 3,934,792.

In a screw conveyor according to U.S. Pat. No. 3,885,734 the above mentioned baffle has the form of an annular disc arranged in a plane substantially perpendicular to the rotational axis.

In a screw conveyor according to U.S. Pat. No. 3,934,792, on the other hand, the baffle is arranged between two adjacent parts of the conveyor thread, extending substantially radially and axially with respect to said rotational axis.

Also WO 99/65610 shows a screw conveyor of the initially defined kind.

Traditionally, screw conveyors for decanter centrifuges have been manufactured out of metal, a strip of sheet metal having been formed into a screw thread and been welded along its radially inner screw-formed edge onto the central body. When desired a baffle of the kind defined above has been welded to the screw thread and possibly even to the central body.

In WO 99/65610 it is mentioned that the rotor and the screw conveyor may be formed of several parts, being releasably connected to each other and also that the screw conveyor may be manufactured in one piece of plastic. However, it is not mentioned more precisely any method for manufacturing of a screw conveyor. A general method for manufacturing of plastic details is injection moulding. However, this method appears not to be appropriate for any of the embodiments of the screw conveyor as shown in WO 99/65610. Thus, it does not appear to be possible to remove an injection-moulded screw conveyor from the mould by screwing it out thereof.

Also in U.S. Pat. No. 5,800,332 there is shown a decanter centrifuge, in which the rotor and the screw conveyor may be formed of several parts being releasably connected to each other.

An object of the present invention is to provide a construction for a screw conveyor, which construction makes possible a simple manufacture of the screw conveyor-even if it is to be made of plastic-ensures transportation of solid particles in the rotor past said baffle and gives stiffness and strength to the conveyor thread in an area where it intersects with the baffle.

Another object of the present invention is to provide a construction for a screw conveyor, which makes possible simple assembly of the screw conveyor.

SUMMARY OF THE INVENTION

According to the invention these objects may be obtained by means of a screw conveyor of the initially defined kind, in which the screw conveyor comprises at least two originally separate parts, each of which comprises a portion of said conveyor thread and which are kept together axially, said baffle constitutes a separate member arranged to be kept in place between said parts of the screw conveyor, when these are kept together axially, and the separate member has a portion, which forms a part of the conveyor thread in an area where the conveyor thread intersects with and extends past the baffle.

By the invention the different parts of the screw conveyor and said baffle may be manufactured each for itself. If the screw conveyor will be made of plastic, the different parts may be formed so that an injection-moulding technique may be used.

In a preferred embodiment of the invention the separate member is arranged to be kept in place by parts of the screw conveyor, when these are kept together axially. Furthermore, said parts of the screw conveyor are detachably connected to each other. This makes easy exchange of the baffle possible, e.g. if it would appear that it has a size which is not optimal for the separation process, in which the decanter centrifuge in question will be used. If required the baffle may be changed as a result of wear.

Preferably, each of the parts of the screw conveyor also comprises a part of the central body. In this case, each of the parts of the central body is suitably provided with a substantially cylindrical portion having axial ribs and grooves, one of the parts having internal ribs and grooves and another of the parts having external ribs and grooves, arranged to keep the different parts of the screw conveyor drivingly coupled together. The parts are arranged to be kept axially together by means of a member, which extends axially within the central body. Hereby, each of the parts may be easily exchanged, if required.

The invention is not limited to the screw conveyor comprising only one conveyor thread and only one baffle. In a preferred embodiment of the invention the screw conveyor comprises two conveyor threads extending like screw threads along and about the central body and being supported by the same such that two screw shaped flow paths are formed around the body. Furthermore, the screw conveyor comprises a baffle of the defined kind for each of said flow paths, the baffles bridging the respective flow paths between different sections of the conveyor threads to prevent free movement of liquid and solid particles along the flow paths towards said outlet for solid particles. In a screw conveyor with two conveyor threads an improved balance is obtained in the screw conveyor, providing improved operation characteristics for the decanter centrifuge.

In the case where the screw conveyor has two baffles of the defined kind these may be formed as one single member arranged to bridge said two flow paths and to be kept in place between said two parts of the screw conveyor. Each of the baffles may be formed as in either U.S. Pat. No. 3,885,734 or U.S. Pat. No. 3,934,792.

In a particular embodiment of the invention said single member may have substantially the form of an annular disc having two diametrically opposed portions, of which one portion forms a part of one of said conveyor threads and the other portion forms a part of the other one of said conveyor threads. Then, the annular disc may comprise two additional diametrically opposed portions, each forming one of said two baffles, which bridge the respective two screw-shaped flow paths. In this case the two baffles are formed as can be seen in U.S. Pat. No. 3,885,734.

BRIEF DESCRIPTION OF THE DRAWINGS

The invention is to be further described in the following with reference to the accompanying drawings, in which.

DETAILED DESCRIPTION OF THE PREFERRED EMBODIMENTS

Figure 1:
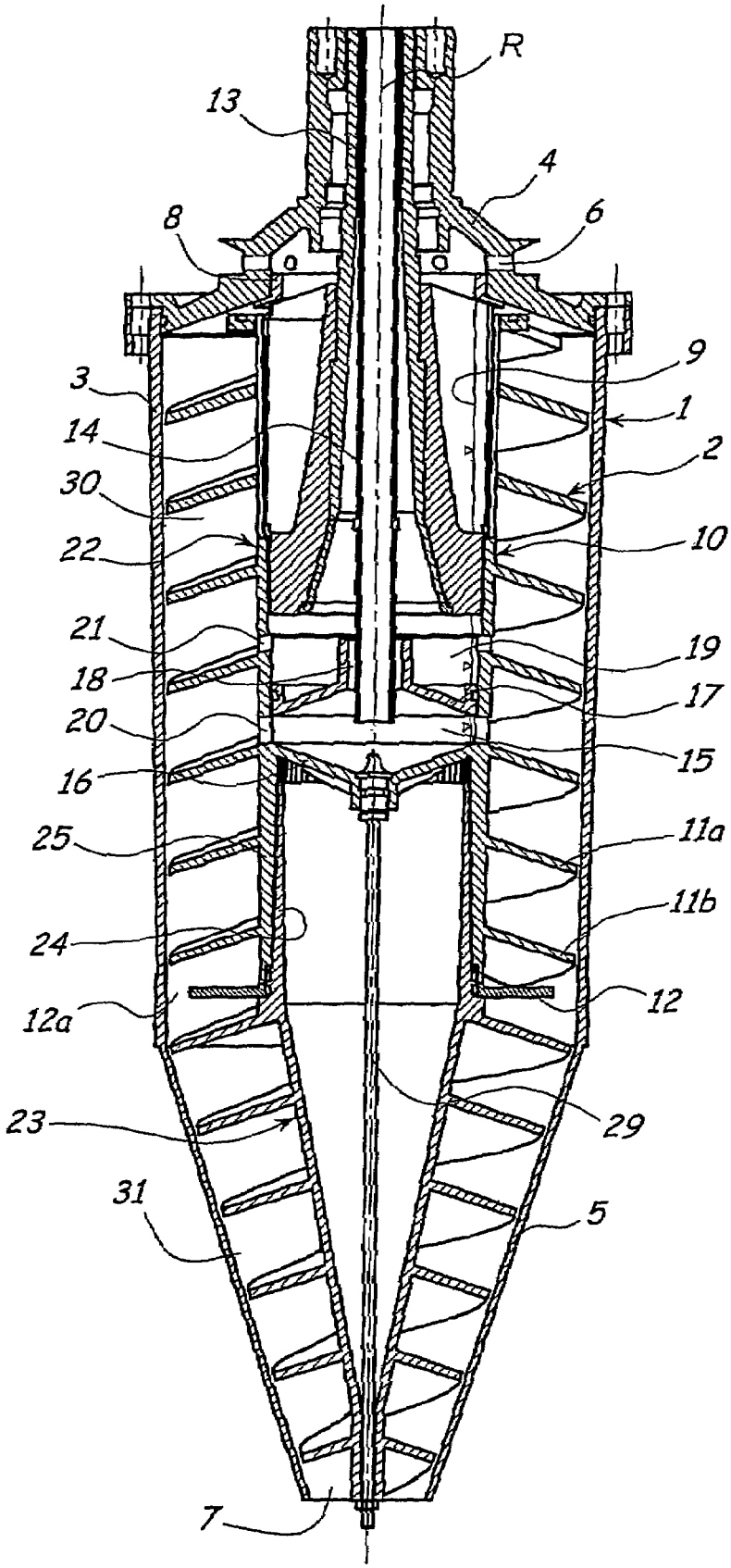
FIG. 1 shows a longitudinal section of a decanter centrifuge comprising a rotor and a screw conveyor, an annular disc being kept between two parts of the screw conveyor, coupled together.

In FIG. 1 there is shown a decanter centrifuge comprising a rotor 1, which is rotatable at a certain velocity about a vertical rotational axis R, and a screw conveyor 2 arranged in the rotor 1 and rotatable about the same rotational axis R, though with a velocity differing from that of the rotor 1. The decanter centrifuge is intended to be suspended vertically in a way as shown in WO 99/65610. Therefore, the necessary arrangement for suspension and driving of the decanter centrifuge is not described herein.

The rotor 1 has a substantially cylindrical upper rotor part 3 comprising or being connected to a hollow rotor shaft 4, and a substantially conical lower rotor part 5. The rotor part 3 and the rotor shaft 4 are connected to each other by means of screws (not shown). Of course, alternative connection members may be used. The rotor parts 3 and 5 may be formed as two separate parts being releasably connected with each other e.g. by means of screws (not shown).

The rotor 1 has several outlets 6 for liquid at its upper end and a centrally and axially directed outlet 7 for sludge at its lower part. In the area of the liquid outlets 6, somewhat below these, a ring 8 is arranged, which forms an overflow outlet for liquid in the rotor flowing towards and out through the outlets 6. The ring 8 is arranged to maintain a free liquid surface in the rotor 1 at a radial level 9. The ring 8 is releasably arranged, which gives the possibility to choose rings with different inner diameter so that the radial level 9 may be changed.

As can be seen from FIG. 1 the screw conveyor comprises a central body 10, which extends along the rotational axis R, two conveyor threads 11*a* and 11*b*, respectively, which extend like screw threads along and about the central body 10, and a disc 12, which extends perpendicular to the rotational axis R from the central body 10 in a direction towards the surrounding rotor part 3. The disc 12 bridges said two flow paths from a radial level at a first distance from the rotational axis R, in this case from the central body 10, to a radial level at a second larger distance from the rotational axis R, the second larger distance being smaller than the distance between the rotational axis R and the circumferential parts of the conveyor threads 11*a* and 11*b*, respectively, in the area of the disc 12.

Hereby, a gap 12*a* is formed between the circumferential part of the disc 12 and the rotor part 3, said gap extending about the rotational axis R except in two areas in which the gap is filled out by the conveyor threads 11*a* and 11*b*.

A hollow shaft 13 extends from above into the rotor 1 through the interior of the rotor axis 4 and supports the central body within the rotor. A stationary inlet pipe 14 intended for a liquid compound to be treated in the rotor 1 extends through the shaft 13. The inlet pipe 14 opens in a first space 15 in the central body 10. The first space 15 is delimited at its lower axial end by a partition 16, which prevents the liquid compound from flowing further downwards within the central body 10. At its upper axial end the space 15 is delimited by a cone-shaped member 17. The cone-shaped member 17 is arranged such that a gap 18 is formed between this and the inlet pipe 14. At its upper axial end the space 15 communicates with a second space 19 through the gap 18. The central body 10 has one or more holes 20 connecting the first space 15 with the separation chamber of the rotor 1, which is formed between the central body 10 and the surrounding rotor part 3 above said disc 12. The central body 10 also has one or more holes 21 connecting the second space 19 with said separation chamber of the rotor 1.

The central body 10 comprises two parts; a first upper part 22 and a second lower part 23. The parts are releasably connected with each other and for this purpose the lower part 23 has a substantially cylindrical portion 24, which on its outside has axially running ribs and grooves, which are in engagement with similar ribs and grooves formed on the inside of a likewise substantially cylindrical portion 25 of the upper part 22 of the central body 10. The two parts 22 and 23 of the central body 10 are thus drivingly connected to each other.

Figure 3:
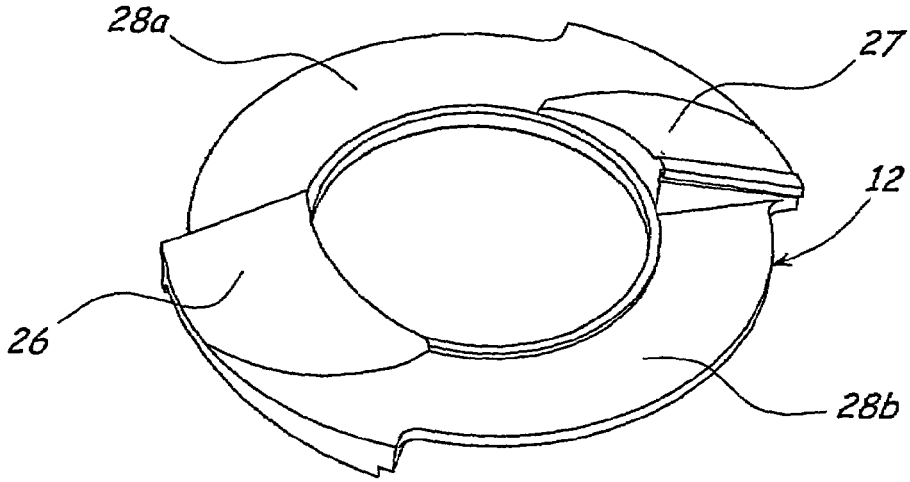
FIG. 3 shows the annular disc in a larger scale and in perspective.

The annular disc 12 (see FIG. 3) comprises two diametrically opposed portions 26 and 27, of which one portion 26 forms a part of the conveyor thread 11*a* and the other portion 27 forms a part of the conveyor thread 11*b*. Furthermore, the disc 12 comprises two diametrically opposed additional portions 28*a* and 28*b*, each of which forms one of two baffles bridging the respective (two) screw-shaped flow paths—, which are formed between the conveyor threads 11*a* and 11*b*.

Figure 2:
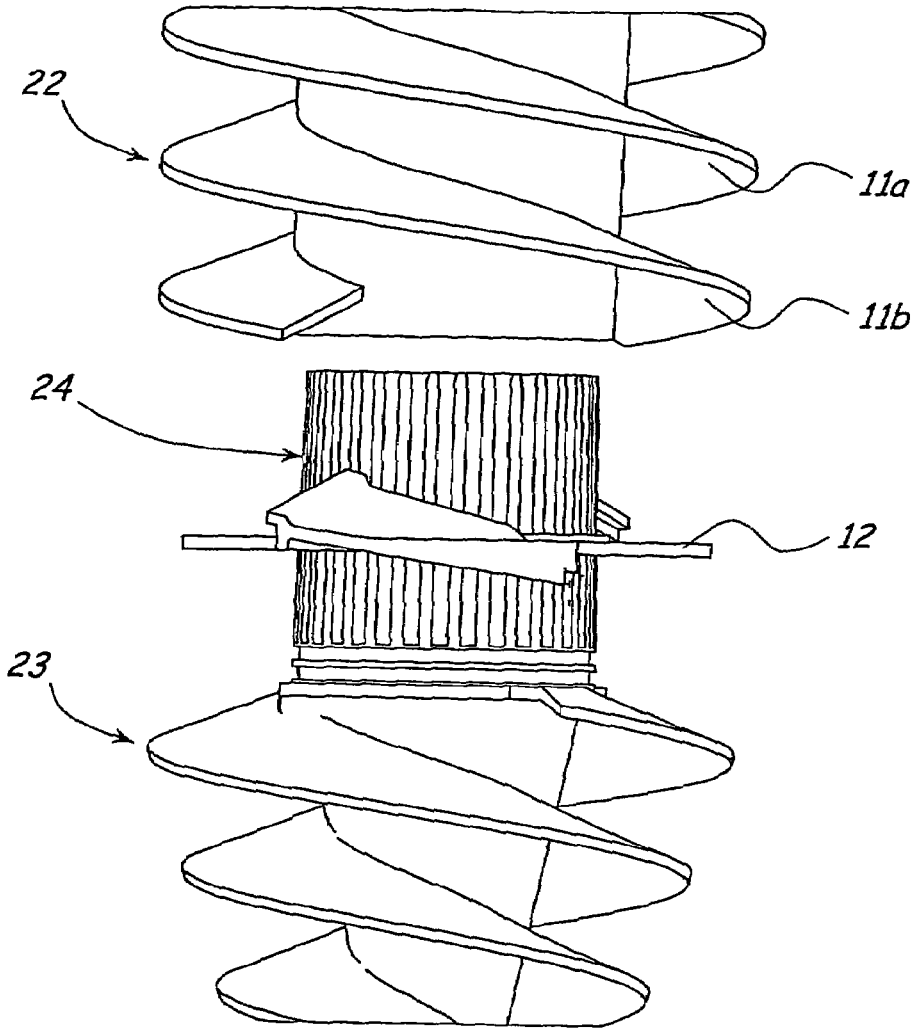
FIG. 2 shows a section of the screw conveyor according to FIG. 1 in a larger scale, said parts of the screw conveyor being situated at some axial distance from each other.

As indicated in FIG. 2 the different parts 22 and 23 of the screw conveyor may be coupled together by being brought axially towards each other. Then the annular disc 12 is placed between the parts 22 and 23 and is kept in place by these parts when they are coupled together.

After the coupling of the parts 22 and 23 together they are kept axially together by means of a bar 29 arranged within the central body 10 (see FIG. 1). The bar 29 extends from the space 15 through the partition 16 and further axially through the whole of the lower part 23 of the body 10. Mounted in the way mentioned above a screw conveyor 2 is obtained having two flow paths, which are delimited by and between the conveyor threads 11*a* and 11*b* extending like screw threads side by side along and about the central body 10. Said disc 1-2 bridges the flow paths to prevent liquid from flowing along these towards the outlet 7. What may by-pass the disc 12 downwards is only sludge, which has been separated from the compound entering through the inlet pipe 14 and which is supplied axially by the conveyor threads 11*a* and 11*b* along the inside of the rotor part 3 through the gap 12*a* between the disc 12 and the rotor part 3.

The disc 12 forms a partition, which divides the interior of the rotor 1 into a separation chamber 30 above the disc 12 and an outlet chamber 31 for sludge below the disc 12. The two chambers 30 and 31 are, thus, in communication with each other only through the gap 12*a*.

By means of the disc 12 it is possible, if desired, to maintain a free liquid surface in the separation chamber 30 at a level radially inside the level of the outlet 7 for separated sludge without having liquid accompanying the sludge out through the outlet 7.

The above described decanter centrifuge operates as follows.

The rotor 1 and the screw conveyor 2 are kept in rotation at somewhat different rotational velocities about the rotational axis R. A compound of liquid and particles suspended therein, having a greater density than the liquid, is supplied into the rotor from above through the inlet pipe 14. The compound flows through the first space 15 and the holes 20 into the rotor, wherein the liquid is brought into rotation. A free liquid surface is formed in the rotor at the level 9, the position of which is determined by the overflow outlet 8 at the upper part of the rotor. Whereas the liquid flows helically about the central body 10 and out through the liquid outlet 6, separated solid particles deposit on the inside of the rotor part 3. By the screw conveyor 2 such particles in the form of sludge are transported along the inside of the rotor part 3 past the disc 12 and further along the inside of the rotor part 5 towards and out through the sludge outlet 7 of the rotor.

What is claimed is:

1. A screw conveyor intended and formed for use in a decanter centrifuge for separation of solid particles from a fluid compound, in which such particles are suspended in a liquid having a smaller density than the particles, the decanter centrifuge comprising:

a rotor having an inlet for said compound, an outlet for separated solid particles and an outlet for liquid having been freed from solid particles, the rotor being rotatable about a rotational axis at a first velocity, and a screw conveyor arranged in the rotor rotatable about the rotational axis at a second velocity different from the first velocity, the screw conveyor comprising:

a central body extending along the rotational axis, at least one conveyor thread extending along and about the central body supported by the same such that a screw shaped flow path is formed around the body, at least one baffle which bridges said flow path between different parts of the conveyor thread to prevent free movement of liquid and solid particles along the flow path towards said outlet for solid particles, and at least two originally separate parts, each of which comprises a portion of said conveyor thread and which are kept together axially, said baffle constituting a separate member arranged to be kept in place between said parts of the screw conveyor, when these are kept together axially, and wherein said separate member has a portion which forms a part of the conveyor thread in an area where the conveyor thread intersects with and extends past the baffle.

2. A screw conveyor according to claim 1, in which said separate member is arranged to be kept in place by said parts of the screw conveyor.

3. A screw conveyor according to claim 1, wherein said parts of the screw conveyor are detachably connected to each other.

4. A screw conveyor according to claim 1 wherein each of said screw conveyor parts comprises a part of the central body.

5. A screw conveyor according to claim 1, wherein each of said screw conveyor parts comprises a substantially cylindrical portion having axial ribs and grooves, one of the screw conveyor parts having internal ribs and grooves and another one of the screw conveyor parts having external ribs and grooves, arranged to keep the parts of the screw conveyor drivingly coupled together.

6. A screw conveyor according to claim 1, wherein the parts of the screw conveyor are arranged to be axially together by means of a member which extends axially through a part of the central body.

7. A screw conveyor according to claim 1, wherein two conveyor threads extend along and about the central body and are supported by the same such that two screw shaped flow paths are formed around the body, and a baffle for each of said flow paths bridges the respective flow paths between different sections of the conveyor threads to prevent free movement of liquid and solid particles along the flow paths towards said outlet for solid particles.

8. A screw conveyor according to claim 7, wherein the baffles are formed as one single member arranged to bridge said two flow paths and to be kept in place between said two parts of the screw conveyor.

9. A screw conveyor according to claim 8, wherein said single member has substantially the form of an annular disc having two diametrically opposed portions, of which one portion forms a part of one of said conveyor threads and the other portion forms a part of the other one of said conveyor threads.

10. A screw conveyor according to claim 9, wherein the annular disc comprises two diametrically opposed additional portions, each forming one of said two baffles, which bridge the respective two screw-shaped flow paths.

11. A screw conveyor according to claim 9, wherein said baffles bridge respective flow paths from a radial level at a first distance from the rotational axis to a radial level at a second greater distance from the rotational axis, the second greater distance being smaller than the distance between the rotational axis and the circumferential parts of said conveyor threads in the areas of the baffles.

12. A screw conveyor according to claim 1, wherein said at least one baffle bridges its flow path from a radial level at a first distance from the rotational axis to a radial level at a second greater distance from the rotational axis, the second greater distance being smaller than the distance between the rotational axis and the circumferential part of said conveyor thread in the area of the baffle in question.

* * * * *